US008090117B2

(12) United States Patent
Cox

(10) Patent No.: US 8,090,117 B2
(45) Date of Patent: Jan. 3, 2012

(54) MICROPHONE ARRAY AND DIGITAL SIGNAL PROCESSING SYSTEM

(76) Inventor: James Cox, Oakville (CA)

( * ) Notice: Subject to any disclaimer, the term of this patent is extended or adjusted under 35 U.S.C. 154(b) by 911 days.

(21) Appl. No.: 11/886,315

(22) PCT Filed: Nov. 21, 2005

(86) PCT No.: PCT/CA2005/001766

§ 371 (c)(1),
(2), (4) Date: May 6, 2008

(87) PCT Pub. No.: WO2006/096959

PCT Pub. Date: Sep. 21, 2006

(65) Prior Publication Data

US 2008/0267422 A1 Oct. 30, 2008

Related U.S. Application Data

(60) Provisional application No. 60/662,132, filed on Mar. 16, 2005.

(51) Int. Cl.
*H04R 3/00* (2006.01)

(52) U.S. Cl. ..... 381/92; 381/91; 381/122; 381/169

(58) Field of Classification Search ..... 381/91, 381/92, 122, 169

See application file for complete search history.

(56) References Cited

U.S. PATENT DOCUMENTS

| | | | | |
|---|---|---|---|---|
| 6,069,961 | A | 5/2000 | Nakazawa | |
| 2005/0123149 | A1* | 6/2005 | Elko et al. | 381/92 |
| 2005/0141723 | A1* | 6/2005 | Lee et al. | 381/26 |
| 2005/0163330 | A1* | 7/2005 | Beguet | 381/92 |

FOREIGN PATENT DOCUMENTS

| | | |
|---|---|---|
| EP | 0 848 572 A1 | 6/1998 |
| EP | 0869697 | 10/1998 |
| GB | 1487364 | 9/1977 |
| GB | 2020807 | 11/1979 |
| WO | WO 00/30402 | 5/2000 |

OTHER PUBLICATIONS

Ilya Balmages et al, "Open-Sphere Designs for Spherical Microphone Arrays", IEEE Transactions on Audio, Speech, and Language Processing, Feb. 2007, pp. 727-732, vol. 15, No. 2.

* cited by examiner

*Primary Examiner* — Phat Cao
(74) *Attorney, Agent, or Firm* — Lynn C. Schumacher; Hill & Schumacher

(57) ABSTRACT

A digital microphone array is configured in an open geometry such as a sphere with a large number of inexpensive microphone elements mounted in opposite-facing pairs. The microphone array with DSP is intended to be placed in a three-dimensional sound field, such as a concert hall or film location, and to completely isolate all sound sources from each other while maintaining their placement in a coherent sound field including reverberance.

8 Claims, 2 Drawing Sheets

MICROPHONE ARRAY AND DIGITAL SIGNAL PROCESSING SYSTEM

CROSS REFERENCE TO RELATED PATENT APPLICATION

This patent application is a National Phase application claiming the benefit of PCT/CA2005/001766 filed on Nov. 21, 2005; which further claims the priority benefit from U.S. Provisional patent application Ser. No. 60/662,132 filed on Mar. 16, 2005, in English, which is incorporated herein in its entirety.

FIELD OF INVENTION

This invention relates to digital microphone arrays for commercial sound recording. The array directly feeds a digital system that analyses the sound field and isolates the individual sound sources for control and processing.

BACKGROUND OF THE INVENTION

Measurement of directional information in a sound field is frequently of great interest. "Directional information" is meant to refer to characteristics of the angular distribution of sound passing through a point. Such information is not readily available through observation of the pressure or intensity alone. The sound pressure is a non-directional measure, whereas intensity is a vector indicating the net direction of energy flow, not necessarily the direction of arrival of component sound waves. Application areas in which knowledge of directional properties of sound fields could be useful include room acoustic analysis and characterization, psychoacoustic assessment of halls or localization of sources and reflections to name just a few.

A straightforward approach at obtaining directional information is to employ a detector that is responsive to sounds arriving from one direction only. A directional detector could mean a single directional transducer, a shotgun microphone, a parabolic microphone, or a microphone array for instance. Performance issues (such as angular resolution, bandwidth, fidelity) and practical issues (such as ease of steering in different directions, size, cost) together dictate what type of detector is desirable.

Beamforming microphone arrays have many favorable properties for directional pickup of sound. They can be designed to yield high directionality, a broad frequency range of operation, and can be steered electronically in many directions simultaneously, without the need for movement of the array.

With modern microphones and digital acquisition hardware, highly sophisticated arrays can be realized quite inexpensively. However, in the case of this invention they can adapt instantaneously to any sound originating from any direction in the soundfield.

Choice of suitable array geometry is an issue. If the goal is to design a directional detector for analyzing sound fields (as in the present work), then in many instances one desirable attribute is spherical symmetry. A spherical array can enable steering an identical beam in any three-dimensional direction. Other three dimensional arrays such as hemisphere or ellipsoids are also possible. Linear or planar arrays do not provide the same functionality.

Beamformer design has developed extensively in the past 50 years or so. Delay-and-sum designs are simple and robust, but only provide maximum directional gain over a narrow frequency range. Superdirective approaches can achieve higher directional gain over a wider frequency range, but at the expense of simplicity and robustness. The signal-to-noise ratio becomes a problem at low frequencies, where the phase change of the sound waves is small over the spatial extent of the array. At higher frequencies, the wavelengths become shorter than the inter-microphone spacing, causing problems with spatial aliasing. General tradeoffs in achieving higher directionality over a broader frequency range include: tighter required microphone tolerances, less noise immunity, and possibly more difficult construction issues.

The utility of microphone arrays is based on the principle that all acoustic events can be represented by four basic elements. These are 'X' which is front/back information (depth), 'Y' which is left/right information (width), 'Z' which is up/down information (height) and 'W' the central point from which the other three elements are referenced.

Advanced arrays capture three dimensional sound at the same 'central point' so all time/or phase-related anomalies created by spaced microphones are eliminated.

U.S. Pat. No. 5,778,083 to Godfrey discloses a microphone array used for surround sound recording. It utilizes a frame for mounting linear pick up microphones such that each of the microphones has its diaphragm facing outwards from the frame, and the diaphragms form a generally elliptical pattern. It is stated that the shape must be non-circular.

U.S. Pat. No. 6,041,127 to Elko discloses a microphone array consisting of 6 small pressure-sensitive omni-directional microphones mounted on the surface of a small rigid nylon sphere. DSP is used to derive sound output.

U.S. Pat. No. 4,675,906 to Sessler and West discloses a microphone array using a cylinder with open ends in which four bi-directional microphones are mounted at 90 degree intervals on the wall of the cylinder, providing a toroidal pick-up pattern. The partially open nature of the cylinder allows the reception of sound waves transversing the cylinder to be received at different intensities.

U.S. Pat. No. 6,851,512 to Fox et al. discloses a microphone array using a modular structure capable of varying configurations, all having closed surfaces.

SUMMARY OF THE INVENTION

Microphone technology has often been based on the model of the eardrum and, to some degree the mechanics of the middle ear. The conceptual process for the present invention started with observations about the inner ear and aural periphery. The individual cilia of the inner ear are nerve endings and each nerve is only capable of firing on the order of 20 times per second, providing a nominal sampling rate of about 20 hz. Human ability to hear up to 20 khz. is clearly based on the massive redundancy of the number of cilia rather than the absolute quality of the signal generated by each one. In effect the aural periphery performs parallel processing of multiple inputs that results in a high quality composite waveform. These observations led to the assumptions that in some digital systems high redundancy can create quality from low grade inputs and that such a system would involve parallel processing.

Such a relevant system was developed in the mid '50s by Bell Labs to perform echo cancellation in long distance lines. The more taps that can be taken on the line the more effective the echo cancellation. A presenter on adaptive digital filters suggested that this technology could be applied to eliminating feedback from PA and monitors in micing a live band. The system referred to is the Adiline neural network. The assumption this led to is that viable adaptive systems such as neural networks that can provide positive and negative spectral masking are in existence and well proven. The neural network analogy to the aural periphery is at least semantically suggestive.

In an initial iteration of this concept a direct reverse engineering of the inner ear with a number of small capacitance microphone elements in a tube was imagined. This led to the assumption that a large number of elements in some physical structure would provide a high quality composite waveform.

It became clear that if these elements were arranged in three-dimensional space that vectoral information about the sound source could be derived. This was being done in analogue beam-forming microphone arrays, but apparently no consideration was being given to the benefit of moving this research into the digital domain. Relevant systems that use multiple transducers to process a field of information are phase array radio telescopes, sonar and radar systems. Such systems have been in existence since the early 60's, with the Dreadnaught sonar and Speedwell radar systems. Contemporary systems such as over the horizon long-wave radar demonstrate the high resolution of such systems. The assumption based on these observations is that viable algorithms are long established in other fields that would be relevant to audio frequencies and wavelengths at the speed of sound.

Spherical three-dimensional arrays are well-suited to analysis of directional information in sound fields. Powerful computers and inexpensive microphones and sound cards are making it possible to realize sophisticated arrays, so frequently the problem comes back to design. A design approach of defining requirements, selecting candidate geometries and appropriate software algorithms, then evaluating the designs was used to arrive at the present invention.

Thus, there is provided a digital microphone array configured in an open geometry such as a sphere with a large number of inexpensive microphone elements mounted in opposite-facing pairs. The microphone array with DSP is intended to be placed in a three-dimensional sound field, such as a concert hall or film location, and to completely isolate all sound sources from each other while maintaining their placement in a coherent sound field including reverberance.

OBJECTS OF THE INVENTION

One object of the invention is to provide an advanced microphone array and DSP that can provide a large number of multiple pick-up patterns, each with a narrow angle of acceptance that can isolate each of the sound sources in the sound field, while completely attenuating sound outside of the angle of acceptance for each of those sources. The sources can be simultaneously processed and the reverberant field can also be maintained as part of the reproduced sound field.

Another object of this invention is to utilize microphones elements mounted in pairs with opposite facing transducer elements.

It is yet another object of the invention to utilize a large number of inexpensive microphone elements to provide high redundancy in measurement.

Another object of the invention is to optimize the geometry of a microphone array to produce phase coherency.

It is another object of the invention to have a microphone array with a generally open structure.

Finally, it is an object of the present invention to provide a microphone array with a key advantage over beamforming systems due to the use of the null. The null in the present invention is an absolute zero—not possible with beamforming.

BRIEF DESCRIPTION OF THE DRAWINGS

The apparatus of the invention will now be described with reference to the accompanying drawings, in which.

DETAILED DESCRIPTION OF THE INVENTION

Figure 1:
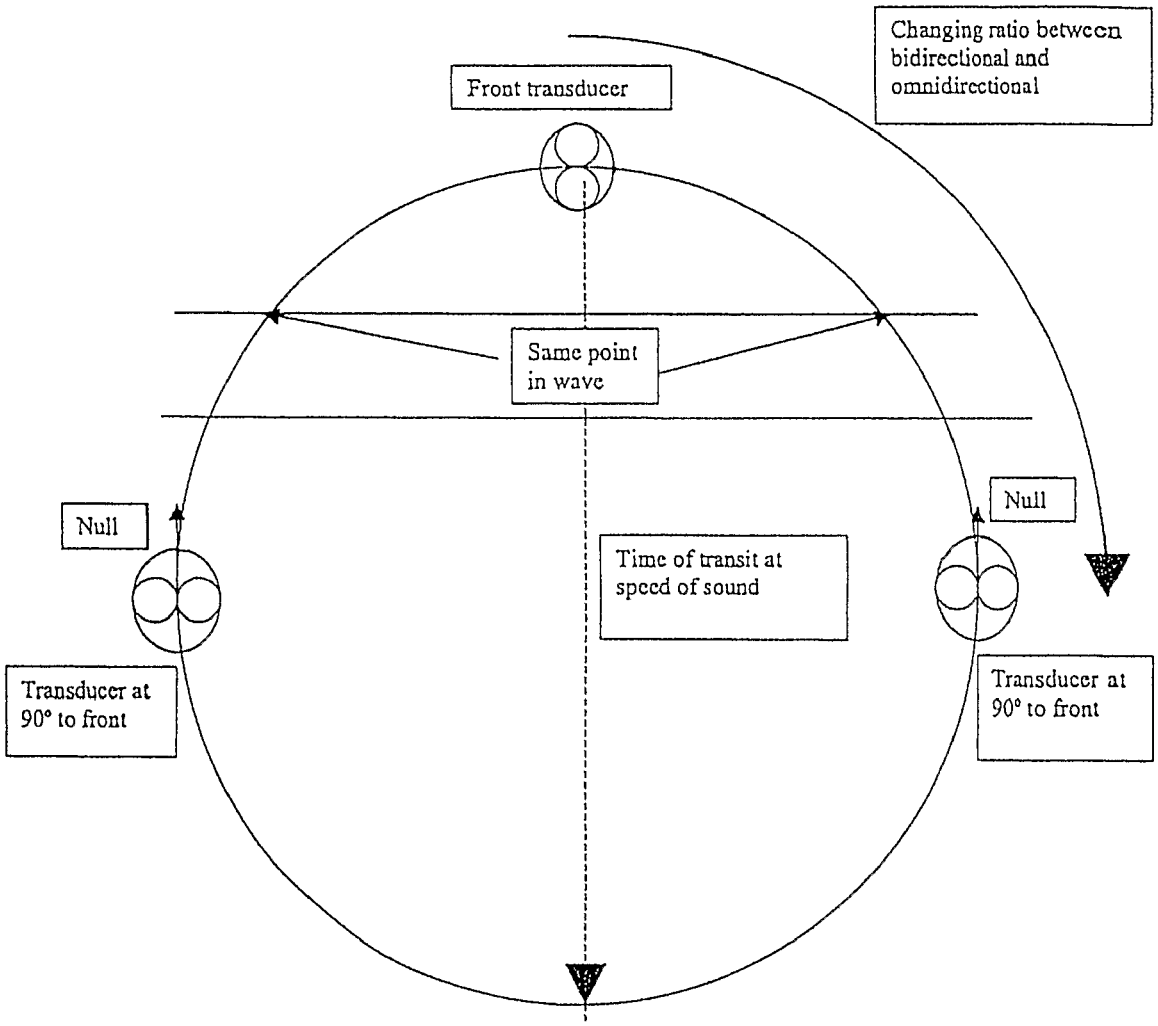
FIG. 1 is a cross-sectional view of one embodiment of the array of the present invention.

In one embodiment, transducers are arranged in an open geodesic sphere approximately the size of the human head as shown in FIG. 1. Commodity grade capacitance microphone elements are mounted in pairs on both sides of the curved struts composing the geodesic sphere, facing outwards and inwards, directly opposed to one another. This allows the elements to function as dual diaphragm capacitance microphones with multiple patterns that are digitally analysed and compared. Rigid (closed) structures would not work with this system.

The development of the dual diaphragm microphone, with a pair of elements facing in opposite directions, allows the microphone to be configured as having an omni-directional, cardioid, or bi-directional pick-up pattern. This involves a three position switch that mixes the two elements in different plus and minus combinations. In the digital domain sampling any patterns can occur almost simultaneously (i.e. at a rate that provides a high grade data flow for each pattern.)

The open sphere allows use of a dual diaphragm system facing both inwards and outwards.

In the various standard and beam-forming patterns the angle of acceptance of the pattern is narrowed. In the present system the observation is made that the angle of rejection in a bi-directional pickup pattern is absolute and at a precise angle, a much higher degree of precision than given by manipulating the angle of acceptance. The pattern can then be inverted with the "negative spectral processing" to get signal only from the angle of rejection.

In one embodiment of the present invention the microphone array is about the size of a human head and light enough to be easily handled when mounted on a boom pole. It should be visually unobtrusive for use in public performance.

The array is fed to an interface that contains microphone pre-amps, A/D converters, and digital signal processing. The output of the interface can be by firewire 800 or USB2 to a standard computer.

All processing is done in real time, so that the system can be used both for recording to hard disk and for live PA and reinforcement applications.

Signal processing in hardware in the interface and software on the computer will provide control and processing of the following features:

a) detect and isolate all the sound sources in an environment so that they can be separately assigned to virtual channels and tracks as discrete sound without leakage from other sources;

b) standard mixing and signal processing can be applied to these discrete channels and tracks with a virtual mixer window on the computer and with auxiliary physical control surfaces;

c) standard and custom surround sound output formats will be derived simultaneously with the discrete channels and tracks;

d) in PA/reinforcement mode, feedback can be eliminated by automatically detecting and locating speakers in the sound field and masking those speakers from the mix;

e) the system will discriminate between near and far field sound sources and can mask sources at defined distances as noise f) wind at the array can be similarly eliminated;

g) rumble originating at a distance or outside a building can be eliminated h) optionally the operator computer interface can provide a graphic display of the architectural space derived from real time acoustic analysis, and a 3D sonic topology of the sound sources in that space. Features could include the ability to graphically define the performance space or spaces from which direct sound is expected and adjust the resolution and angle of acceptance for the various sound sources in that space. Further a user could define angles of acceptance for reflected sound, and simultaneously reject direct sound originating in the reflected field, such as audience, building, and equipment noise.

System output can be to:

internal or external hard drive;

consoles;

PA and reinforcement systems;

Surround sound systems.

Additional features could include identifying the spectral characteristics of a moving sound source and tracking it as a single discrete source or combining more than one microphone array at different angles on the same sources, so that a phase coherent composite signal is created. This would be used on complex sources such as a drum set, or to cover actors, singers or speakers turning upstage, for example.

In one preferred embodiment of the present invention the array could have on the order of 64 dual elements feeding commodity grade analogue to digital converters. The geometry would be an open 32 face non-regular polyhedron, or a 32 face geodesic sphere.

Phase-coherent wave forms of high quality are derived in the digital domain from multiple samples of the same waveform. The quality of the signal is a product of the system redundancy rather than the absolute quality of the individual components at a high sampling rate.

Other geometries are also possible such as open hemispheres or open ellipsoids, although phase coherence issues can arise with elliptical structures.

Vector Analysis

Again referring to FIG. 1, waveforms are analysed for their source direction as they pass through the open structure, such as a geodesic sphere.

The timing of the waveform provides one set of information. It is first detected as a unique waveform at the element closest to the source. It will leave at the element opposite in the sphere with a delay dependent on the speed of sound. The same portion of the waveform will be at 90 degrees to the axis between these two elements as it travels through the sphere. Pressure fluctuations such as wind will be filtered out if they travel at less than the speed of sound through the sphere.

Triangulation of the source can be performed by calculating the ratio of the omnidirectional response to the bidirectional response of the elements. At the element closest to the source there is no difference, but at 90 degrees to the source the bi-directional pattern has a null response. The ratio changes around the circumference of the sphere as the waveform passes through, from a 1:1 ratio to zero.

Since a sphere the size of the human head is omni-directional to frequencies below 1.5 khz the source of such fundamentals will be derived from the unique harmonic series attributable to them which can be analysed for vector. Where such a series does not exist, in practice the human perceptual system would not discriminate as to their source. Such signals could occupy a separate channel or track by processing them through a low pass filter.

Sound Field Processing Software

Figure 2:
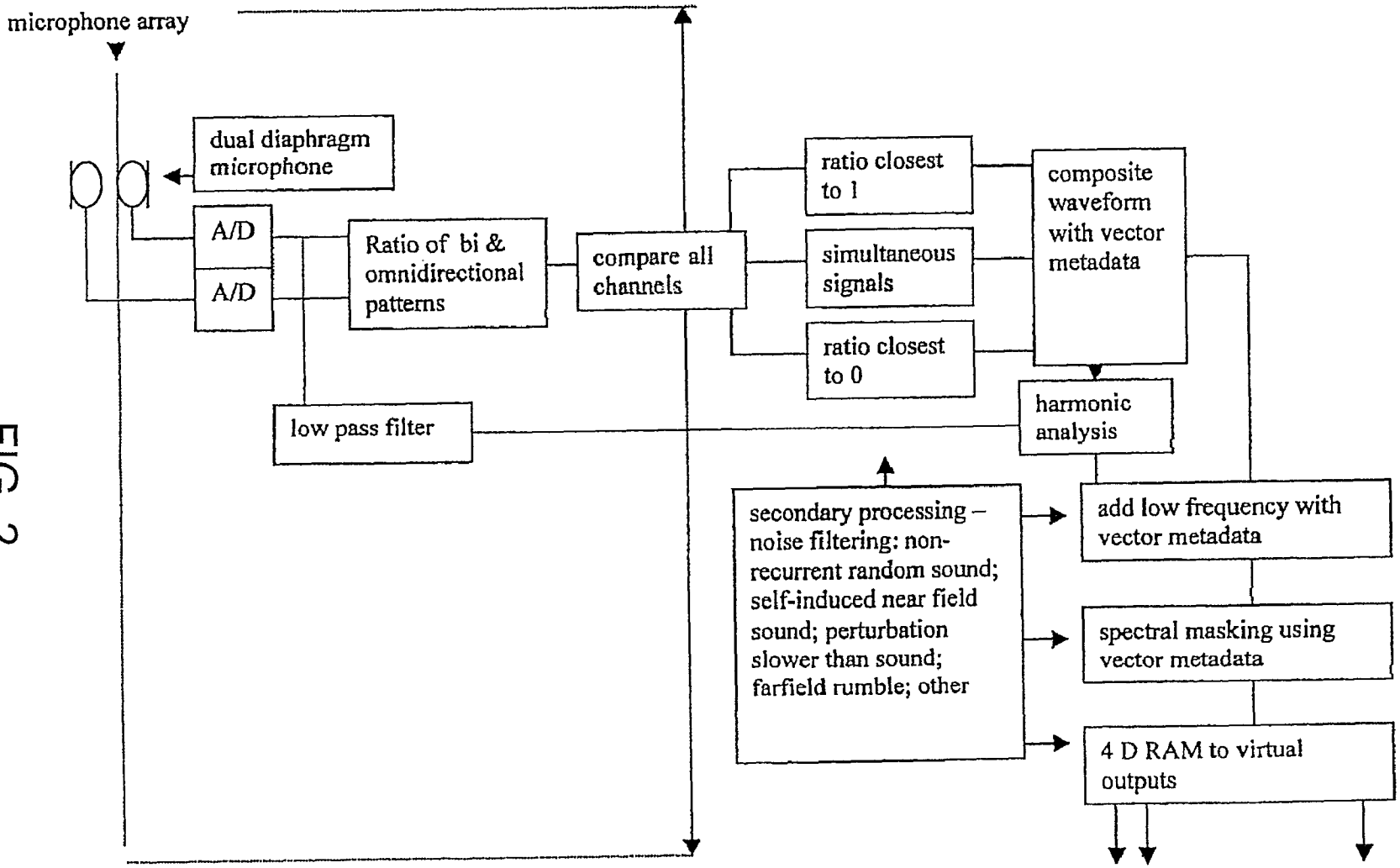
FIG. 2 is a functional block diagram of the system of the invention.

Software to automatically calculate and isolate the origin of the individual waves could take two distinct approaches—timing and triangulation. Please refer to the block diagram of FIG. 2.

A mathematical model depending on timing and triangulation calculations noted above would likely be efficient at calculating the source of the sound. Isolating the sound sources so that they can be output as discrete sources will likely require a higher order of spectral discrimination and masking. At 90 degrees to the sound wave there will be no signal on the bi-directional pattern since the null is pointed at the sound source. Whatever signal is present on the bi-directional pattern can be filtered out of the signal on the omni-directional pattern, leaving the signal from the source that the null is pointing at. In effect, a negative spectral mask is constructed of the signal on the bi-directional pattern.

Digital adaptive systems are efficient at producing the spectral masking necessary for such isolation. The high redundancy of the elements of the phase array provides enough comparative information for an adaptive system to function well. The output would be phase coherent composite waveforms for each of the discrete sound sources and the acoustical field.

RAM can also be used so that bits from different words in a sequence will constitute a time vector that represents the wave form (i.e. RAM is used as a dynamic three dimensional space with an added time parameter).

Ancillary Tools and Software

Software weights the processing power by angle to accommodate the likelihood that performance will take place in front of the array and that a reverberant field will exist on other angles. This makes the processing more efficient and allows for acoustic analysis of the space. Analysis of delay in the reflected sound at various angles is likely to be sufficient to define the space, in a form analogous to sonar or radar. If necessary, the space could be outlined with a device creating a tone and simultaneously transmitting an rf sync pulse. By triggering this at various places such as corners, instruments, audience, reinforcement speakers, etc., the operator could interactively build a layout of the space that could be used for acoustic analysis. The space could be represented as an architectural representation, and as a sonic topology, through a graphic user interface.

For concert and reinforcement applications, software identifies the position of speakers using vector analysis, and masks these sound sources from passing through the system, thus preventing feedback. With acoustic management and surround speakers complex acoustic environments could be created. Speaker systems using boundary effect might be employed in the reverberant field with a mic feeding a speaker 180' out of phase pointing from opposite sides of a large plate to minimize reflections. An intelligent system is necessary to manage long wavelengths in comparison to the plate.

Software would channel the various source sounds to a virtual mixer that could then constitute a recording or PA feed. It is anticipated that efficient information processing and flow into RAM, hard drive, etc. means that raw data and points where analysis is made will likely not be according to existing protocols.

Software could also be developed that would identify the soundprint of different instruments and provide a library of mics and treatments so that mixing decisions could be automated.

The microphone array could be placed both to the front and rear of a performance area with the software providing a composite of the individual sound sources or a best line of sight of the source. Complex three-dimensional sources such as drum sets could be handled this way. As well, actors or singers turning upstage could be reproduced well. If the system is not fully capable in tracking moving sound sources automatically in real time rf transmitters could be worn and an x-y antenna system integrated into the performance area. This positional information could then be used to guide the array.

It will be understood that modifications can be made in the embodiments of the invention described herein.

What is claimed is:

1. A microphone array comprising:

a plurality of individual pressure-sensitive microphone elements, each said microphone element having substantially an omni-directional response pattern, and each said microphone elements being mounted in pairs in a back to back configuration with another one of said plurality of said microphone elements, said pairs of microphone elements being arranged at pre-configured points on a 3 dimensional array, wherein the 3 dimensional array is a geodesic sphere.

2. The array according to claim 1 wherein the pre-configured points on the geodesic sphere are the apexes of each face on the sphere.

3. The array according to claim 1 wherein the 3 dimensional array is a hollow structure.

4. The array according to claim 3 wherein the 3 dimensional array is as acoustically transparent as possible.

5. The array according to claim 1 wherein the microphone elements are commercial grade capacitance microphone elements.

6. The array according to claim 1 wherein the geodesic sphere is approximately the size of a human head.

7. The array according to claim 1 wherein said microphone elements in the array are connected to a digital signal processing system.

8. A microphone array comprising:

a hollow body for supporting a plurality of microphone elements in a prearranged array; wherein the body forms a geodesic sphere having an outer plane, wherein at least some of the microphone elements are mounted in pairs around the array, wherein one element in each of said pairs is mounted with its diaphragm coplanar with said outer plane facing inward and said other microphone element of said pair being mounted with its diaphragm mounted coplanar with said outer surface and facing outwards.

* * * * *